US012108779B2

(12) United States Patent
Sutton

(10) Patent No.: US 12,108,779 B2
(45) Date of Patent: Oct. 8, 2024

(54) TOBACCO BLEND

(71) Applicant: NICOVENTURES TRADING LIMITED, London (GB)

(72) Inventor: Joseph Sutton, London (GB)

(73) Assignee: NICOVENTURES TRADING LIMITED, London (GB)

( * ) Notice: Subject to any disclaimer, the term of this patent is extended or adjusted under 35 U.S.C. 154(b) by 404 days.

(21) Appl. No.: 16/348,769

(22) PCT Filed: Nov. 8, 2017

(86) PCT No.: PCT/EP2017/078638
§ 371 (c)(1),
(2) Date: May 9, 2019

(87) PCT Pub. No.: WO2018/087164
PCT Pub. Date: May 17, 2018

(65) Prior Publication Data

US 2019/0289901 A1 Sep. 26, 2019

(30) Foreign Application Priority Data

Nov. 10, 2016 (GB) ..... 1618993

(51) Int. Cl.
*A24B 15/18* (2006.01)
*A24B 9/00* (2006.01)
(Continued)

(52) U.S. Cl.
CPC ..... *A24B 15/00* (2013.01); *A24B 15/10* (2013.01); *A24B 15/18* (2013.01); *A24B 15/306* (2013.01);
(Continued)

(58) Field of Classification Search
CPC ..... A24B 15/18; A24B 15/306; A24B 15/167; A24B 3/08
See application file for complete search history.

(56) References Cited

U.S. PATENT DOCUMENTS 4,516,590 A 5/1985 Teng
4,881,556 A 11/1989 Clearman et al.
(Continued)

FOREIGN PATENT DOCUMENTS

AU 2016352781 B2 1/2019
AU 2017358570 A1 5/2019
(Continued)

OTHER PUBLICATIONS

New Zealand First Examination Report, Application No. 752969, mailing date Oct. 17, 2019, 4 pages.
(Continued)

*Primary Examiner* — Christopher M Rodd
*Assistant Examiner* — Jennifer A Kessie
(74) *Attorney, Agent, or Firm* — WOMBLE BOND DICKINSON (US) LLP

(57) ABSTRACT

Described herein is a composition for use in a device for generating an inhalable medium, the composition comprising (i) 50-85% by weight of air-cured and/or fire-cured tobacco (ii) 0-50% by weight of flue-cured and/or sun-cured tobacco that has not been subjected to any further treatment which affects the flavor properties of tobacco, and (iii) 0-50% by weight of flue-cured and/or sun-cured tobacco that has been further treated to enhance the flavor properties of tobacco.

7 Claims, 2 Drawing Sheets

(51) Int. Cl.

| | |
|---|---|
| ***A24B 15/00*** | (2006.01) |
| ***A24B 15/10*** | (2006.01) |
| ***A24B 15/30*** | (2006.01) |
| ***A24D 3/12*** | (2006.01) |
| ***A24F 1/14*** | (2006.01) |
| ***A24F 40/10*** | (2020.01) |
| ***A24F 40/20*** | (2020.01) |
| ***A24F 40/30*** | (2020.01) |
| ***A24F 40/42*** | (2020.01) |

(52) U.S. Cl.

CPC ..... *A24D 3/12* (2013.01); *A24F 40/30* (2020.01); *A24F 1/14* (2013.01); *A24F 40/10* (2020.01); *A24F 40/20* (2020.01); *A24F 40/42* (2020.01)

(56) References Cited

U.S. PATENT DOCUMENTS

| | | | | |
|---|---|---|---|---|
| 5,499,636 | A | 3/1996 | Bagget | |
| 5,613,505 | A | 3/1997 | Campbell | |
| 5,649,554 | A | 7/1997 | Sprinkle et al. | |
| 6,298,858 | B1 * | 10/2001 | Coleman, III ..... | A24B 15/306 131/296 |
| 6,499,489 | B1 | 12/2002 | Coleman | |
| 7,025,066 | B2 | 4/2006 | Lawson et al. | |
| 7,726,320 | B2 | 6/2010 | Robinson | |
| 8,434,496 | B2 | 5/2013 | Chen et al. | |
| 2004/0173228 | A1 | 9/2004 | Coleman | |
| 2007/0235046 | A1 | 10/2007 | Gedevanishvili | |
| 2007/0267407 | A1 | 11/2007 | Loveless | |
| 2009/0255923 | A1 | 10/2009 | Buehrer | |
| 2010/0300463 | A1 | 12/2010 | Chen et al. | |
| 2012/0103353 | A1 | 5/2012 | Sebastian et al. | |
| 2012/0125354 | A1 | 5/2012 | Byrd | |
| 2013/0014772 | A1 | 1/2013 | Quiming | |
| 2013/0255702 | A1 | 10/2013 | Griffith et al. | |
| 2013/0269719 | A1 * | 10/2013 | Marshall ..... | A24B 15/20 131/290 |
| 2014/0299125 | A1 | 10/2014 | Buchberger | |
| 2015/0272219 | A1 | 10/2015 | Hatrick | |
| 2015/0282256 | A1 | 10/2015 | Iguro | |
| 2015/0366262 | A1 | 12/2015 | Woodman | |
| 2016/0205992 | A1 | 7/2016 | Bell | |
| 2018/0325174 | A1 | 11/2018 | Sutton | |

FOREIGN PATENT DOCUMENTS

| | | | |
|---|---|---|---|
| CN | 101773286 | | 7/2010 |
| CN | 102228121 | A | 11/2011 |
| CN | 103462203 | A | 12/2013 |
| CN | 104095291 | A | 10/2014 |
| CN | 104095295 | A | 10/2014 |
| CN | 104397876 | | 3/2015 |
| CN | 104856235 | A | 8/2015 |
| CN | 105707970 | | 6/2016 |
| EA | 0/23124 | B1 | 4/2016 |
| EP | 110693 | A | 6/1984 |
| EP | 1940254 | A2 | 7/2008 |
| EP | 2907397 | A1 | 8/2015 |
| EP | 3373752 | A1 | 9/2018 |
| GB | 2140270 | | 11/1984 |
| GB | 2495923 | A | 5/2013 |
| JP | H0851175 | B2 | 2/1996 |
| JP | 2010506594 | A | 3/2010 |
| JP | WO2016076178 | A1 | 7/2017 |
| KR | 100385395 | B1 | 8/2003 |
| KR | 10-20120104533 | A | 9/2012 |
| RU | 103281 | U1 | 4/2011 |
| RU | 2575434 | C2 | 2/2016 |
| RU | 2597540 | C2 | 9/2016 |
| WO | WO 00/28840 | | 5/2000 |
| WO | WO 02/37990 | | 5/2002 |
| WO | WO2004041006 | A1 | 5/2004 |
| WO | WO2007051163 | A2 | 5/2007 |
| WO | WO-2008108889 | A1 | 9/2008 |
| WO | WO2012072770 | A1 | 6/2012 |
| WO | WO-2012078960 | A1 | 6/2012 |
| WO | WO2013155177 | A1 | 10/2013 |
| WO | WO-2013155645 | A1 | 10/2013 |
| WO | WO2014032784 | A1 | 3/2014 |
| WO | WO2014048745 | A1 | 4/2014 |
| WO | WO2014116974 | | 7/2014 |
| WO | WO2015046385 | A1 | 4/2015 |
| WO | WO 2015063485 | | 5/2015 |
| WO | WO2015063486 | | 5/2015 |
| WO | WO2015063487 | | 5/2015 |
| WO | WO-2016062777 | A1 | 4/2016 |
| WO | WO2016/076178 | | 5/2016 |
| WO | WO-2016179376 | A1 | 11/2016 |
| WO | WO2017081487 | A1 | 5/2017 |
| WO | WO-2018087164 | A1 | 5/2018 |

OTHER PUBLICATIONS

Canadian Office Action and Examination Search Report, Canadian Application No. 3004948, mailing date Dec. 13, 2019, 3 pages.

Russian Office Action, Application No. 2019113935, mailing date Mar. 3, 2020, 56 pages.

Great Britain Search Report, Application No. GB 1618994.6, dated Apr. 28, 2017, 5 pages.

Korean Office Action, Korean Patent Application No. (PCT) 10-2018-7013472, mailing date Apr. 23, 2020, 7 pages.

Application and File History for U.S. Appl. No. 16/348,764, filed May 9, 2019, Inventor: Sutton.

Application and File History for U.S. Appl. No. 16/348,769, filed May 9, 2019, Inventor: Sutton.

English Translation of Office Action mailed Jul. 30, 2019 for Japanese Application. P2018-523415, 4 pages.

International Preliminary Report on Patentability for Application No. PCT/GB2016/053556, mailed on May 24, 2018, 12 pages.

International Preliminary Report on Patentability for Application No. PCT/EP2017/078638, mailed on May 23, 2019, 10 pages.

International Preliminary Report on Patentability for Application No. PCT/EP2017/078641, mailed on May 23, 2019, 10 pages.

International Search Report and Written Opinion for Application No. PCT/EP2016/075734, mailed Apr. 6, 2017, 12 pages.

International Search Report and Written Opinion for Application No. PCT/EP2017/078641, mailed Feb. 27, 2018, 12 pages.

International Search Report and Written Opinion for Application No. PCT/GB2016/053556, mailed on Apr. 25, 2017, 16 pages.

International Search Report for Application No. PCT/EP2017/078638, mailed on Feb. 27, 2018, 3 pages.

Korean Office Action mailed Mar. 20, 2019 for Korean Application No. 10-2018-7012346, 15 pages.

Office Action dated Jul. 28, 2020 for Japanese Application No. 2019-524209 filed Nov. 8, 2017, 12 pages.

Office Action for Korean Application No. 10-2019-7013583 mailed on Mar. 9, 2021, 14 pages.

Office Action For Russian Application No. 2020124180, mailed on Nov. 26, 2020, 18 pages.

Office Action mailed Dec. 13, 2019 for Canadian Patent Application No. 3,004,948, 3 pages.

Office Action mailed Jun. 25, 2019 for Japanese Application No. 2018-519865, 3 pages.

Office Action mailed Jan. 28, 2020 for Russian Application No. 2019113934, 15 pages.

Office Action mailed Jan. 28, 2020 for Russian Application No. 2019113935, 53 pages.

Office Action mailed Mar. 28, 2019 for Canadian Application No. 3003514, 6 pages.

Office Action mailed Mar. 3, 2020 for Russian Application No. 2019113934, 126 pages.

Office Action mailed Mar. 9, 2021, for Korean Application No. 10-2019-7013582, 06 pages.

Search Report mailed Mar. 31, 2016 for Great Britain Application No. GB1520056.1, 5 pages.

(56) References Cited

OTHER PUBLICATIONS

Roemer, Ewald et al.; Scientific assessment of the use of sugars as cigarette tobacco ingredients; Critical Reviews in Toxicology; Mar. 2012; 42(3); 244-278.
Great Britain Search Report, Application No. GB1618993.8, dated Apr. 28, 2017, 5 pages.
International Search Report and Written Opinion, Application No. PCT/EP2017/078638, 3 pages.
Examination Report received for New Zealand Patent Application No. 767215, mailed on Dec. 17, 2021, 6 pages.

* cited by examiner

TOBACCO BLEND

CROSS REFERENCE TO RELATED APPLICATIONS

The present application is a National Phase entry of PCT Application No. PCT/EP2017/078638, filed Nov. 8, 2017, which claims priority from GB Patent Application No. 1618993.8, filed Nov. 10, 2016, each of which is hereby fully incorporated herein by reference.

TECHNICAL FIELD

Embodiments described herein relate to a tobacco composition, smoking articles comprising the tobacco composition and methods of use of the tobacco composition.

BACKGROUND

Smoking articles such as cigarettes, cigars and the like burn tobacco during use to create tobacco smoke. Attempts have been made to provide alternatives to these articles that burn tobacco by creating products that release compounds without burning. These may be referred to as non-combustible smoking articles. Examples of such products are heating devices which release compounds by heating, but not burning, the material. The heating volatilizes at least one component of the material, typically forming an inhalable aerosol. The material may be for example tobacco or other non-tobacco products, which may or may not contain nicotine. These products may be referred to as heat-not-burn devices, tobacco heating devices or tobacco heating products.

As another example, there are so-called e-cigarette devices. These devices typically contain a liquid which is heated to vaporize the liquid to produce an inhalable vapor or aerosol. The liquid may contain nicotine and/or flavorings and/or aerosol-generating substances, such as glycerol. The known e-cigarette devices typically do not contain or use tobacco.

As another example, there are e-cigarette/tobacco heating product hybrid devices, also known as electronic tobacco hybrid devices. These hybrid devices contain a liquid which is vaporized by heating to produce an inhalable vapor or aerosol. The liquid may contain nicotine and/or flavorings and/or aerosol-generating substances, such as glycerol. The vapor or aerosol passes through material in the device to entrain one or more constituents in the material to produce the inhaled medium. The material may be for example tobacco or other non-tobacco products, which may or may not contain nicotine.

SUMMARY

In accordance with some embodiments described herein, there is provided a composition for use in a device for generating an inhalable medium, the composition comprising

- 50-85% by weight of air-cured and/or fire-cured tobacco
- 0-50% by weight of flue-cured and/or sun-cured tobacco that has not been subjected to any further treatment which affects the flavor properties of tobacco, and
- 0-50% by weight of flue-cured and/or sun-cured tobacco that has been further treated to enhance the flavor properties of tobacco.

In some cases, the tobacco composition essentially consists of or consists of

- 50-85% by weight of air-cured and/or fire-cured tobacco
- 0-50% by weight of flue-cured and/or sun-cured tobacco that has not been subjected to any further treatment which affects the flavor properties of tobacco, and
- 0-50% by weight of flue-cured and/or sun-cured tobacco that has been further treated to enhance the flavor properties of tobacco.

In accordance with some embodiments described herein, there is provided apparatus for generating an inhalable medium, the apparatus comprising:

- a container for holding a liquid;
- a heater for volatilizing liquid held in the container;
- a chamber containing the tobacco composition described herein; and
- an outlet;
- the arrangement being such that, in use, an inhalable medium passes out of the outlet, the medium comprising one or more constituents of the tobacco composition and volatilized liquid in the form of at least one of a vapor and an aerosol. Such apparatus may be referred to as an electronic tobacco hybrid device.

In accordance with some embodiments described herein, there is provided a cartridge for use in a device for heating tobacco material, the cartridge containing the tobacco composition described herein. Suitably, the cartridge may be adapted for use in the device for generating an inhalable medium described herein, the cartridge comprising the chamber containing the tobacco composition.

In accordance with some embodiments described herein, there is provided a method of generating an inhalable medium using an apparatus comprising a container holding a liquid, a heater for volatilizing the liquid, a tobacco composition described herein, and an outlet, the method comprising:

- volatilizing the liquid held in the container;
- forming an inhalable medium, the inhalable medium comprising (a) the volatilized liquid in the form of at least one of a vapor and an aerosol and (b) one or more constituents of the tobacco composition; and
- passing the inhalable medium out of the outlet.

Further features and advantages will become apparent from the following description of several embodiments, given by way of example only, which is made with reference to the accompanying drawings.

BRIEF DESCRIPTION OF THE DRAWINGS

Examples of apparatus for generating an inhalable medium according to embodiments of the invention are described below with reference to the accompanying drawings, in which:

FIG. 4 shows a schematic longitudinal cross-sectional view of an example of a cartridge having a liquid container and an integral container for solid material; and.

DETAILED DESCRIPTION

Figure 1:
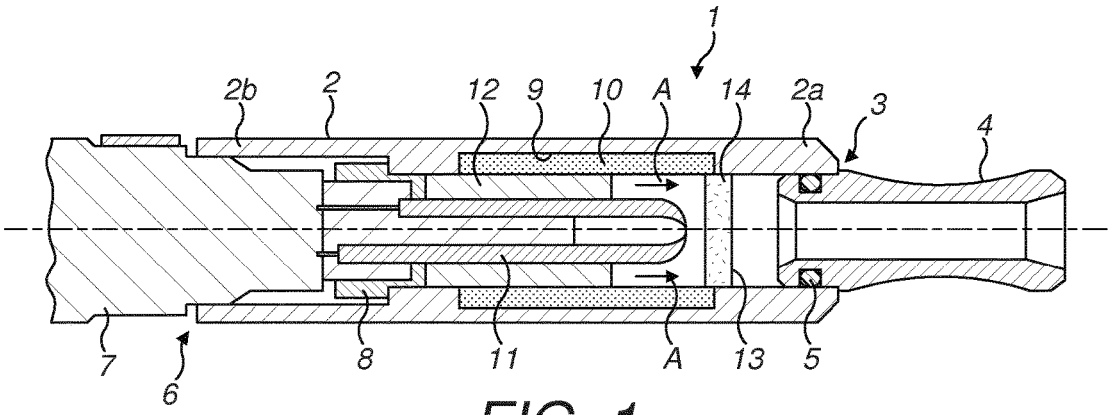
FIG. 1 shows a schematic longitudinal cross-sectional view of an example of an apparatus for generating an inhalable medium.

In accordance with some embodiments described herein, there is provided a composition for use in a device for generating an inhalable medium, the composition comprising

- 50-85% by weight of air-cured and/or fire-cured tobacco
- 0-50% by weight of flue-cured and/or sun-cured tobacco that has not been subjected to any further treatment which affects the flavor properties of tobacco, and
- 0-50% by weight of flue-cured and/or sun-cured tobacco that has been further treated to enhance the flavor properties of tobacco.

Suitably, the composition is for use in a device for generating an inhalable medium, wherein the device is a non-combustible smoking article. In other words, the composition may be for use in a non-combustible smoking article to generate an inhalable medium.

The inventors have established that the tobacco compositions disclosed herein are suitable for use in an electronic tobacco hybrid device. The tobacco compositions disclosed herein are such that tobacco flavors and/or aromas are entrained in the volatilized liquid at the operating temperature of the hybrid device.

The liquid in such hybrid devices is typically volatilized at around 150-250° C. (which is the same operating temperature as an e-cigarette). A feature of so-called e-cigarette devices is that the flavor of the inhalable medium is often very different from the flavor of a conventional tobacco product; the hybrid devices described herein entrain components of tobacco in the aerosol formed by heating the liquid so that the inhaled medium more closely matches the flavor of conventional combustible cigarettes.

The inventors have found that tobacco compositions used in combustible products are not optimal for such hybrid devices because the tobacco flavorings released on combustion do not become entrained in the volatilized liquid at the device operating temperature. Similarly, the inventors have found that the tobacco compositions used in tobacco heating products are generally not optimal for use in a hybrid device, because the tobacco flavorings in THP tobaccos are released at a much higher temperature (tobacco heating products generally operate at >250° C., typically at >300° C.).

The tobacco compositions described herein are suitable for use in an electronic tobacco hybrid device because flavor/aroma components are released from the tobacco composition at the temperature of the liquid vapor/aerosol.

The tobacco composition described herein comprises from about 50%, 60%, 65%, 70% or 75% to about 85%, 75%, 65% or 60% by weight of air-cured and/or fire-cured tobacco. In some cases, the composition comprises 50-60% or 65-85% or 65-75% or 75-85% by weight of air-cured and/or fire-cured tobacco. In some cases, the composition may comprise air-cured and fire-cure tobacco. In some cases, the composition may comprise air-cured tobacco and no fire-cured tobacco. In some cases, the composition may comprise fire-cured tobacco and no air-cured tobacco.

The tobacco composition described herein comprises from about 0%, 5%, 10%, 15%, 25% or 35% to about 50%, 45%, 35%, 30%, 25% or 10% by weight of flue-cured and/or sun-cured tobacco that has not been subjected to any further treatment which affects the flavor properties of tobacco. In some case, the composition comprises 0-10%, 15-25% or 35-45% by weight of flue-cured and/or sun-cured tobacco that has not been subjected to any further treatment which affects the flavor properties of tobacco. In particular, flue-cured and/or sun-cured tobacco that has not been subjected to any further treatment has not be aged, fermented, exposed to elevated temperature and/or pressure, or treated with additives or the like. This tobacco has not been exposed to conditions that have allowed a Maillard reaction to occur.

The tobacco composition may comprise shredded (cut rag), bobbinized, pelletized, spheronized and/or agglomerated tobacco. In some cases, the tobacco composition may be porous, such that an aerosol or vapor can pass through the tobacco composition. Thus, components of the tobacco composition are more efficiently entrained in the aerosol/vapor.

The tobacco composition may have a density of about 180 $kg/m^2$, 200 $kg/m^2$ or 210 $kg/m^2$ to about 300 $kg/m^2$, 260 $kg/m^2$ or 250 $kg/m^2$.

The tobacco composition may additionally comprise a flavoring. As used herein, the terms "flavor" and "flavoring" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The tobacco composition may additional comprise one or more casings, such as invert sugar, molasses, cane sugar, honey, cocoa, licorice, polyols such as glycerol and propylene glycol and acids such as malic acid.

Tobacco Curing

Tobacco is generally cured after harvesting to reduce the moisture content of the tobacco, usually from around 80% to around 20% or lower. Tobacco can be cured in a number of different ways, including air-, fire-, flue- and sun-curing. During the curing period, the tobacco undergoes chemical change and turns from a green color to yellow, orange (light, cured tobaccos), mahogany, brown or nearly black (dark, cured tobaccos).

Air-cured tobacco is generally prepared through hanging the tobacco plant in well-ventilated barns and drying the tobacco in air over a period of four to eight weeks. Air-cured tobacco is low in sugar, has a light, sweet flavor, and a high nicotine content.

In some cases, the air-cured tobacco may be a "dark" air-cured tobacco. Dark air-cured tobacco is formed using heavy type leaves and has a dark color after curing. In some cases, the dark air-cured tobacco may be or include carmen cubita. In some cases, the composition does not include any light air-cured tobacco such as Burley tobacco.

Fire-cured tobacco is generally prepared through hanging the tobacco plant in large barns where fires of hardwoods are kept on continuous or intermittent low smolder. Fire curing takes between three days and ten weeks. Fire curing produces a tobacco low in sugar and high in nicotine, and which has a smoky or earthy flavor.

In some cases, the fire-cured tobacco may be a "dark" fire-cured tobacco. Dark-fired leaves are subjected to smoke from smoldering wood during the early stages of curing and result in leaves with a very dark color that are long and heavy bodied. In some cases, the composition does not include any light fire-cured tobacco.

Flue-cured tobacco is generally prepared through hanging the tobacco plant in large barns which have flues running from externally fed fire boxes, heat-curing the tobacco without exposing it to smoke. The process generally takes about a week, and the temperature is raised slowly over the course of the curing. The cured tobacco is high in sugar and has medium to high levels of nicotine. It generally has a mild flavor.

Flue-cured tobacco is a "light" tobacco. The flavor of flue-cured tobaccos varies depending on the flue heat treatment and the ripeness of the tobacco leaf at the start of the curing process. Flue-cured leaves can be categorized into semi-flavor and full-flavor leaves. In some cases, the composition comprises full-flavor flue-cured tobacco, and in some particular cases, it comprises no semi-flavor flue-cured tobacco.

Sun-cured tobacco dries uncovered in the sun. It is also known as oriental tobacco. Sun-cured tobacco is low in sugar and nicotine.

Thus, in some embodiments, there is provided a composition for use in a device for generating an inhalable medium, the composition comprising

- 50-85% by weight of dark, air-cured and/or dark fire-cured tobacco
- 0-50% by weight of flue-cured and/or sun-cured tobacco that has not been subjected to any further treatment which affects the flavor properties of tobacco, and
- 0-50% by weight of flue-cured and/or sun-cured tobacco that has been further treated to enhance the flavor properties of tobacco.

Flavor Enhanced Flue-Cured or Sun-Cured Tobacco

The tobacco composition comprises 0-50% by weight of a flue-cured and/or sun-cured tobacco that has been treated to enhance the flavor properties of tobacco. In some cases, the composition comprises at least about 5%, 10% 25% or 45% by weight to about 50%, 35%, 15% or 10% by weight of flue-cured and/or sun-cured tobacco that has been further treated to enhance the flavor properties of tobacco. In some cases, the composition comprises 0-15%, 0-10%, 25-35% or 35-50% by weight of flue-cured and/or sun-cured tobacco that has been further treated to enhance the flavor properties of tobacco. In some cases, the composition does not comprise sun-cured tobacco that has been further treated to enhance the flavor properties of tobacco.

The treatment to enhance the flavor properties of the flue-cured and/or sun-cured tobacco may comprise, for example, exposure to elevated heat and/or pressure, and/or fermentation, and/or ageing, and/or treatment with additives. Ageing may typically be effected by storing the tobacco at 20-40° C. for 1-3 years, for example. Fermentation, ageing and additive treatment all slow tobacco preparation and add cost. Further, treatment with additives is often avoided because consumers often like "natural" tobacco products. Thus, in some cases, the treatment to enhance the flavor properties of the flue-cured and/or sun-cured tobacco does not include fermentation, aging or treatment with additives.

In some cases, the treatment comprises exposing the tobacco to conditions in which a Maillard reaction occurs in the tobacco. In some cases, the treatment comprises reducing the microbial content of the tobacco. In some cases, the treatment results in the tobacco having a caramel-like flavor.

The treatment may comprise, for example, treatment described in WO2015063485, WO2015063486 and WO2015063487, each of which is incorporated herein by reference in their entirety.

Treatment according to WO2015063485, WO2015063486 or WO2015063487 on flue-cured tobacco has been found to produce tobacco with an enhanced flavor profile or enhanced organoleptic properties (compared to the flavor profile of tobacco which has not been treated or which has only been cured using conventional processes). This may be through the removal or reduction of negative organoleptic factors and/or the increase in positive organoleptic properties.

In an example flavor enhancing process, the treatment may comprise providing tobacco material within a moisture-retaining material and exposing the tobacco material to a processing temperature at least about 45° C. wherein the tobacco has a packing density on a dry weight basis of at least 200 kg/m$^3$ at the start of the process and has a moisture content of between about 10% and 23% before and during treatment.

In some cases, the moisture retaining material may comprise a polymer such as polyethylene, polypropylene, polyesters and nylons.

In some cases, the packing density may be from about 200 kg/m$^3$ or 300 kg/m$^3$ to about 500 kg/m$^3$ or 400 kg/m$^3$. In some cases, the processing temperature may be at least about 45° C., 50° C., 55° C., 60° C., 65° C. or 70° C. In some cases, it may be less than about 120° C., 100° C., 80° C. or 70° C. In some cases, the tobacco temperature may rise during the treatment process due to exothermic reactions taking place. In some cases, the relative humidity may be between 40% and 90% during the processing, suitably 55% to 70%, suitably 60%. In some cases, the treatment time period may be from 4 days to 65 days, suitably 15-50 days, suitably 30 days.

For example, flue-cured tobacco (13 wt % moisture) may be placed in a polyethylene box and processed at 60° C. and 60% relative humidity for 30 days.

It is believed that a Maillard reaction takes place during this example treatment process. The amino acid content is reduced and caramelization may also occur, reducing the sugar levels. This treatment process may also reduce the nicotine content, resulting in a less bitter taste.

The example treatment process may result in a treated tobacco which has a low microbial (or microorganism) count. For example, the microbial content of the treated tobacco may less than 1000 CFU/g, 500 CFU/g, 200 CFU/g or 100 CFU/g (measured using Petrifilm® Aerobic Count plates).

The example treatment process may result in a treated tobacco in which the content of nitrosamines is not significantly increased relative to the pre-treated, flue-cured tobacco. In some cases, this means that the nitrosamine content has not increased by more than about 0.20 μg/g, 0.15 μg/g, 0.10 μg/g or 0.05 μg/g relative to the pre-treated, flue-cured tobacco.

In some cases, the treatment comprise a case-leaf drying process. In such a process, sugar containing casings such as invert sugar, molasses, cane sugar and/or honey are added to the tobacco by added tobacco to an aqueous solution containing the casing. The tobacco is then dried using hot air in an oven that ensures the tobacco is first dried, then reaches temperatures of around 120-140° C., whereby the natural amino acids in the tobacco and the sugar components combine to produce flavor components via the Maillard reaction.

Five compositions A-E will now be described in more detail.

Composition A

In some embodiments, the composition comprises 50-65% by weight of air-cured and/or fire-cured tobacco, 35-50% by weight of flue-cured and/or sun-cured tobacco that has not been subjected to any further treatment which affects the flavor properties of tobacco, and 0-15% by weight of flue-cured and/or sun-cured tobacco that has been further treated to enhance the flavor properties of tobacco.

Suitably such compositions may comprise 50-65% by weight of dark air-cured tobacco and 0-10%, or 0-5% by weight of fire-cured tobacco.

Such compositions may comprise 25-40% by weight of sun-cured tobacco that has not been subjected to any further treatment which affects the flavor properties of tobacco and 5-15% by weight of flue-cured tobacco that has not been subjected to any further treatment which affects the flavor properties of tobacco.

Such compositions may comprise 0-15% by weight of flue-cured tobacco that has been further treated to enhance the flavor properties of tobacco and 0 wt % of sun-cured tobacco that has been further treated to enhance the flavor properties of tobacco.

Composition B

In some embodiments, the composition comprises 50-65% by weight of air-cured and/or fire-cured tobacco, 10-30% by weight of flue-cured and/or sun-cured tobacco that has not been subjected to any further treatment which affects the flavor properties of tobacco, and 20-40% by weight of flue-cured and/or sun-cured tobacco that has been further treated to enhance the flavor properties of tobacco.

Suitably such compositions may comprise 50-65% by weight of dark fire-cured tobacco. The composition may comprise 0-10% or 0-5% by weight of air-cured tobacco.

Such compositions may comprise 0-5 wt % by weight of sun-cured tobacco that has not been subjected to any further treatment which affects the flavor properties of tobacco and 5-30%, suitably 15-25% by weight of flue-cured tobacco that has not been subjected to any further treatment which affects the flavor properties of tobacco.

Such compositions may comprise 20-40% or 24-35% by weight of flue-cured tobacco that has been further treated to enhance the flavor properties of tobacco and 0 wt % of sun-cured tobacco that has been further treated to enhance the flavor properties of tobacco.

Composition C

In some embodiments, the composition comprises 50-65% by weight of air-cured and/or fire-cured tobacco, 0-10% by weight of flue-cured and/or sun-cured tobacco that has not been further treated to enhance the flavor properties of tobacco, and 35-50% by weight of flue-cured and/or sun-cured tobacco that has been further treated to enhance the flavor properties of tobacco.

Suitably such compositions may comprise 50-65% by weight of dark air-cured tobacco. The composition may comprise 0-10% or 0-5% by weight of fire-cured tobacco.

Such compositions may comprise 0-5%, suitably 0% by weight of flue-cured and/or sun-cured tobacco that has not been further treated to enhance the flavor properties of tobacco.

Such compositions may comprise 35-50% by weight of flue-cured tobacco that has been further treated to enhance the flavor properties of tobacco and 0 wt % of sun-cured tobacco that has been further treated to enhance the flavor properties of tobacco.

Composition D

In some embodiments, the composition comprises 65-75% by weight of air-cured and/or fire-cured tobacco, 0-10% by weight of flue-cured and/or sun-cured tobacco that has not been further treated to enhance the flavor properties of tobacco, and 25-35% by weight of flue-cured and/or sun-cured tobacco that has been further treated to enhance the flavor properties of tobacco.

Suitably such compositions may comprise 65-75% by weight of dark air-cured and/or dark fire-cured tobacco, suitably 45-55% by weight of dark air-cured tobacco and 10-30% or 15-25% by weight of dark fire-cured tobacco.

Such compositions may comprise 0-5%, suitably 0% by weight of flue-cured and/or sun-cured tobacco that has not been further treated to enhance the flavor properties of tobacco.

Such compositions may comprise 25-35% by weight of flue-cured tobacco that has been further treated to enhance the flavor properties of tobacco and 0 wt % of sun-cured tobacco that has been further treated to enhance the flavor properties of tobacco.

Composition E

In some embodiments, the composition comprises 70-85% by weight of air-cured and/or fire-cured tobacco, 5-25%, suitably 10-20% by weight of flue-cured and/or sun-cured tobacco that has not been subjected to any further treatment which affects the flavor properties of tobacco, and 0-10% by weight of flue-cured and/or sun-cured tobacco that has been further treated to enhance the flavor properties of tobacco.

Suitably such compositions may comprise 10-20% by weight of dark fire-cured tobacco. The composition may comprise 55-75% or 60-70% by weight of air-cured tobacco.

Such compositions may comprise 5-15 wt % by weight of sun-cured tobacco that has not been subjected to any further treatment which affects the flavor properties of tobacco and 0-10% by weight of flue-cured tobacco that has not been subjected to any further treatment which affects the flavor properties of tobacco.

Such compositions may comprise 0-10% by weight of flue-cured tobacco that has been further treated to enhance the flavor properties of tobacco and 0 wt % of sun-cured tobacco that has been further treated to enhance the flavor properties of tobacco.

Device Containing the Tobacco Composition

In some embodiments, there is provided a non-combustible smoking article containing the tobacco composition described herein.

In accordance with some embodiments described herein, there is provided apparatus for generating an inhalable medium, the apparatus comprising:

a container for holding a liquid;

a heater for volatilizing liquid held in the container;

a chamber containing the tobacco composition described herein; and an outlet;

the arrangement being such that in use an inhalable medium passes out of the outlet, the medium comprising one or more constituents of the tobacco composition and volatilized liquid in the form of at least one of a vapor and an aerosol. Such products may be referred to as an electronic tobacco hybrid device.

In some cases, the apparatus comprises means for heating the tobacco composition to volatilize components of the tobacco and form a first aerosol and/or vapor. The liquid may be volatilized to form a second vapor and/or aerosol, which may be combined with the first vapor and/or aerosol to form the inhalable medium. In some cases, one heater may heat both the liquid and the tobacco composition. In some cases, the tobacco composition may additionally comprise an aerosol generating agent.

In other cases, there is provided apparatus for generating an inhalable medium, the apparatus comprising:

a container for holding a liquid;

a heater for volatilizing liquid held in the container;

a chamber containing the tobacco composition described herein; and an outlet;

the arrangement being such that in use liquid volatilized by the heater passes, in the form of at least one of a vapor and an aerosol, through the tobacco composition to thereby entrain one or more constituents from the tobacco composition to produce the inhalable medium which passes out of the outlet.

These hybrid devices provide an inhalable medium which has, for example, a flavor or flavors that are derived from the tobacco composition contained in the apparatus in use. In a particular application, the vapor or aerosol passing over the tobacco composition is hot and so heats the material to evaporate or volatilize one or more constituents from the tobacco composition, allowing the constituents to be taken up into the inhalable medium.

In an embodiment, the heater for volatilizing liquid contained in the container is arranged to vaporize the liquid.

In an embodiment, the apparatus comprises a cooler or cooling zone downstream of the heater and upstream of the chamber, the cooler or cooling zone being arranged to cool vaporized liquid to form an aerosol of liquid droplets which in use passes through the tobacco composition in the chamber. The cooler may be arranged in effect to act as a heat exchanger, allowing for recovery of heat from the vapor. The recovered heat can be used for example to pre-heat the tobacco composition and/or to assist in heating the liquid.

In another embodiment, the heater for heating liquid contained in the container is arranged to heat the liquid to form an aerosol.

In an embodiment, the apparatus comprises a second heater for heating the tobacco composition in the chamber. This enables the tobacco composition to be heated by the heater, which encourages release of compounds from the tobacco composition, and optionally allows a lower temperature to be used for the heated liquid.

In an embodiment, the apparatus is battery-operated.

In an embodiment, the heater or each heater is an electrically resistive heater.

In an embodiment, the liquid container is removable. The liquid container may be in the form of a pot or the like (which in some embodiments may be annular for example), and/or an absorbent wadding or the like. The whole liquid container containing the liquid may in effect be a disposable item which is replaced as a whole after use. As an alternative, the arrangement may be such that the user removes the liquid container from the apparatus, replaces used liquid or tops up liquid in the container, and then places the container back in the apparatus.

In some cases, the liquid container may be non-removable from the apparatus. In such an embodiment, the user may just replace used liquid or top up liquid in the container after use as necessary.

In some cases, the liquid container and the chamber are an integral unit.

In some cases, the container holds liquid, the liquid containing nicotine.

In some cases, the container holds liquid, the liquid containing one or more flavorings.

In some cases, the container holds liquid, the liquid containing one or more aerosol generating agents. In this context, an "aerosol generating agent" is an agent that promotes the generation of an aerosol. An aerosol generating agent may promote the generation of an aerosol by promoting an initial vaporization and/or the condensation of a gas to an inhalable solid and/or liquid aerosol. In some embodiments, an aerosol generating agent may improve the delivery of flavor from the aerosol generating material.

In general, any suitable aerosol generating agent or agents may be included in the aerosol generating material. Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

In some cases, the chamber is removable from the apparatus. The chamber may be, for example, in the form of a cartridge or the like which contains the tobacco composition before use. The whole chamber containing the tobacco composition may in effect be a disposable item which is replaced as a whole after use. As an alternative, the arrangement may be such that the user removes the chamber from the apparatus, replaces used material in the chamber, and then places the chamber back in the apparatus.

In accordance with some embodiments described herein, there is provided a cartridge for use in a device for heating tobacco material, the cartridge containing the tobacco composition described herein. Suitably, the cartridge may be adapted for use in the device for generating an inhalable medium described herein, suitably a non-combustible smoking article, the cartridge comprising the chamber containing the tobacco composition.

In some cases, the cartridge further comprises the liquid container and liquid.

In accordance with some embodiments described herein, there is provided a method of generating an inhalable medium using an apparatus comprising a container holding a liquid, a heater for volatilizing the liquid, a tobacco composition described herein, and an outlet, the method comprising:

volatilizing the liquid held in the container;

forming an inhalable medium, the inhalable medium comprising (a) the volatilized liquid in the form of at least one of a vapor and an aerosol and (b) one or more constituents of the tobacco composition; and passing the inhalable medium out of the outlet.

In some cases, there is provided a method of generating an inhalable medium using an apparatus comprising a container holding a liquid, a heater for volatilizing the liquid, a tobacco composition described herein, and an outlet, the method comprising:

volatilizing the liquid held in the container;

entraining one or more constituents from the tobacco composition in at least one of a vapor and an aerosol formed by the volatilized liquid by passing the at least one of a vapor and an aerosol through the tobacco composition to generate the inhalable medium; and passing the inhalable medium out of the outlet.

Suitably, the method of generating an inhalable medium may use a non-combustible smoking article.

Examples of apparatus for generating an inhalable medium according to the second will now be described, with reference to the accompanying drawings. Referring to FIG. 1, there is shown an example of an apparatus 1 for generating an inhalable medium. In broad outline, the apparatus 1 volatilizes a liquid to form a vapor or an aerosol which passes through a material so as to produce an inhalable medium that contains one or more constituents derived from the material.

In this respect, first it may be noted that, in general, a vapor is a substance in the gas phase at a temperature lower than its critical temperature, which means that for example the vapor can be condensed to a liquid by increasing its pressure without reducing the temperature. On the other hand, in general, an aerosol is a colloid of fine solid particles or liquid droplets, in air or another gas. A "colloid" is a substance in which microscopically dispersed insoluble particles are suspended throughout another substance.

Returning to FIG. 1, the apparatus 1 of this example has a generally hollow cylindrical outer housing 2. The housing 2 has an open end 3. In this example, a tubular mouthpiece 4 is provided in the open end 3. The mouthpiece 4 in this example is removable by a user from the housing 2. An O-ring or other seal 5 assists in sealing the mouthpiece 4 in the housing 2. At or towards the other end 6 of the housing 2 is a battery 7 for powering various components of the apparatus 1, as will be discussed further below. The battery 7 may be a rechargeable battery or a disposable battery. A controller 8 is also provided in the housing 2 for controlling the operation of various components of the apparatus 1, as will be discussed further below.

The housing 2 has a container 9 for holding or containing a liquid 10. Various different forms for the container 9 may be used. In the example of FIG. 1, the container 9 is in the form of an annular chamber 9 provided in the housing 2 between the open end 3 and the other end 6. In this particular example, the housing 2 is in two parts, a first part 2*a* being towards the open end 3 and a second part 2*b* towards the other end 6. The first and second parts 2*a*, 2*b* of the housing 2 may connect to each other via a screw thread, a bayonet fitting or the like. In use, a user can separate the first and second parts 2*a*, 2*b* of the housing 2 to allow the liquid 10 to be replenished or replaced as necessary. Alternatively, the mouthpiece 4 can be removed to provide access to the container 9. It will be understood however that other arrangements are possible. For example, the liquid 10 may be provided in a discrete annular pot-like container which can be removed as a whole from the housing 2. Such a discrete container may be disposable so that the user replaces the liquid 10 by fitting a new container with liquid 10 in the housing 2. Alternatively, such a container may be reusable. In such a case, the user may replenish or replace liquid 10 in the container whilst it has been removed from the housing 2 and then replace the refilled container in the housing 2. It will be understood that the housing 2 need not be in two parts and that other arrangements enabling access for the user may be provided, for example, to enable refilling in situ.

A heater 11 is provided generally centrally of the housing 2, that is, centrally along the length and width of the housing 2 in this example. In this example, the heater 11 is powered by the battery 7 and is therefore electrically connected to the battery 7. The heater 11 may be an electrically resistive heater, including for example a nichrome resistive heater, a ceramic heater, etc. The heater 11 may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including non-electrical heating arrangements or other electrical heating arrangements, such as an inductive heating arrangement.

This heater 11 is provided for volatilizing the liquid 10. In the example shown, an annular wick 12 surrounds the heater 11 and is in (thermal) contact with the heater 11. The outermost surface of the annular wick 12 is in contact with liquid 10 contained in the liquid container 9. The wick 12 is generally absorbent and acts to draw in liquid 10 from the liquid container 9 by capillary action. The wick 12 is preferably non-woven and may be for example a cotton or wool material or the like, or a synthetic material, including for example polyester, nylon, viscose, polypropylene or the like. Whilst this will be described more fully below, it may be noted here that in use, liquid 10 drawn into the wick 12 is heated by the heater 11. The liquid 10 may be volatilized so as to produce an aerosol of liquid droplets or sufficiently heated to produce a vapor. The aerosol or vapor so produced exits the wick 12 and passes towards the mouthpiece 4 as shown by the arrows A under the action of the user drawing on the mouthpiece 4. The heater 11 and wick 12 may be provided as a single, effectively integral item, sometimes referred to as an "atomizer", such that the heating and wicking is effectively carried out by a single unit. In some cases, the heater may be surrounded by an annular wick (as described above), and in other cases, the wick may be surrounded by an annular heater.

The housing 2 further contains a chamber 13 which holds or contains a tobacco composition 14 in the apparatus 1. In use, a user can access the chamber 13 to replace or replenish the tobacco composition 14 through the open end 3 of the housing 2 by removing the mouthpiece 4 and/or by separating the two parts 2*a*, 2*b* of the housing 2. Various different forms for the chamber 13 may be used. For example, the chamber 13 may be a tube which is completely open at both ends and which contains the tobacco composition 14. As another example, the chamber 13 may be a tube which has one or more end walls which have through holes through which a vapor or aerosol can pass. The chamber 13 may remain in situ within the housing 2 whilst the user removes and replaces the tobacco composition 14. Alternatively, the chamber 13 containing the tobacco composition 14 may be a discrete item which in use is inserted into and removed from the housing 2 as a whole. A removable chamber 13 of this type may be disposable so that the user replaces the tobacco composition 14 by fitting a new chamber 13 containing fresh tobacco composition 14 into the housing 2. As an alternative, the chamber 13 may be reusable. In such a case, the user may replace the tobacco composition 14 in the chamber 13 whilst the chamber 13 has been removed from the housing 2 and then replace the refilled chamber 13 in the housing 2. In yet another example, the chamber 13 may comprise clips or the like provided internally of the housing 2 and which retain the tobacco composition 14 in position. In some examples, the tobacco composition 14 could simply fit snugly within the chamber 13. As another alternative, the container 9 for containing the liquid 10 may itself be arranged to support or carry the tobacco composition 14. For example, the container 9 may have one or more clips or a tube or the like for receiving and holding the tobacco composition 14 in position. Such a dual function container 9/chamber or receptacle 13 for both containing the liquid 10 and receiving the tobacco composition 14 may be in the form of a cartridge or the like and may be a disposable item or may be re-useable, with the liquid 10 and tobacco composition 14 being replaced or topped up by the user as required. In some cases, it may be that the user only needs to top up or replace the tobacco composition 14 from time to time, with sufficient liquid 10 being provided for several uses. Once the liquid 10 has been consumed, the user disposes of the dual function container 9/receptacle 13 and uses a new one. Likewise, it may be that the user only needs to top up or replace the liquid 10 from time to time, with sufficient tobacco composition 14 being provided for several uses. Once the tobacco composition 14 has been consumed, the user disposes of the dual function container 9/receptacle 13 and uses a new one. Specific examples of dual function containers/receptacles are discussed further below.

The tobacco composition 14 is located in the housing 2 downstream of the location where the aerosol or vapor is produced from the liquid 10 and upstream of the open end 3 of the housing 2 and the mouthpiece 4. In this particular example, the tobacco composition 14 is effectively provided in the same portion or chamber of the housing 2 as the wick 12. The aerosol or vapor produced from the liquid 10 exits the wick 12 and passes as shown by the arrows A towards the tobacco composition 14 under the action of the user drawing on the mouthpiece 4. In particular embodiments, the tobacco composition 14 is porous so that the aerosol or vapor passes through the tobacco composition 14 and then through the open end 3 of the housing 2 and the mouthpiece 4. In some embodiments, the tobacco composition 14 and/or its chamber 13 are arranged so that there is no air gap between the tobacco composition 14/chamber 13 and the interior of the housing 2 so that the aerosol or vapor flows entirely through the tobacco composition 14.

The liquid 10 is preferably a liquid that is volatilizable at reasonable temperatures, preferably in the range of 100-300° C. or more particularly around 150-250° C., as that helps to keen down the power consumption of the apparatus 1. Suitable materials include those conventionally used in e-cigarette devices, including for example propylene glycol and glycerol (also known as glycerine).

The tobacco composition 14 imparts a flavor to the aerosol or vapor produced from the liquid 10 as the aerosol or vapor passes through the tobacco composition 14. As the aerosol or vapor passes through and over the tobacco composition 14, the hot aerosol or vapor entrains organic and other compounds or constituents from the tobacco material 14 that lend tobacco its organoleptic properties, thus imparting the flavor to the aerosol or vapor as it passes to the mouthpiece 4.

Apparatus 1 provides nicotine for the user. The nicotine may be provided in the liquid 10, may be obtained from the tobacco composition 14, may be provided as a coating or the like on the tobacco composition 14, or any combination of these. Likewise, flavorings may be added to the tobacco composition 14 and/or to the liquid 10.

As mentioned above, heating devices are known that release compounds by heating, but not burning, tobacco. It may be noted here that tobacco is a poor heat conductor, and yet the heating of tobacco in known tobacco heating devices is by heat conduction through the tobacco from an exterior surface of the tobacco (typically by virtue of an electrical resistive heating element which is in contact with the surface of the tobacco). This means that the tobacco may be heated inefficiently and/or the power consumption of the device is high. In the case of a battery-operated device, high power consumption is a problem for the user as the battery or batteries need to be recharged or replaced frequently. This can be avoided in embodiments of the present apparatus 1 as the tobacco composition 14 can be heated by the hot aerosol or vapor passing through the body of the porous tobacco composition 14, providing for more effective and efficient heating throughout the body of the tobacco composition 14. This can help to lower the power consumption of the apparatus 1.

In the example shown in FIG. 1, the only heat source for heating the tobacco composition 14 in the apparatus 1, which is required so as to generate the organic and other compounds or constituents from the tobacco composition 14, is the hot aerosol or vapor produced from heating the liquid 10.

Figure 2:
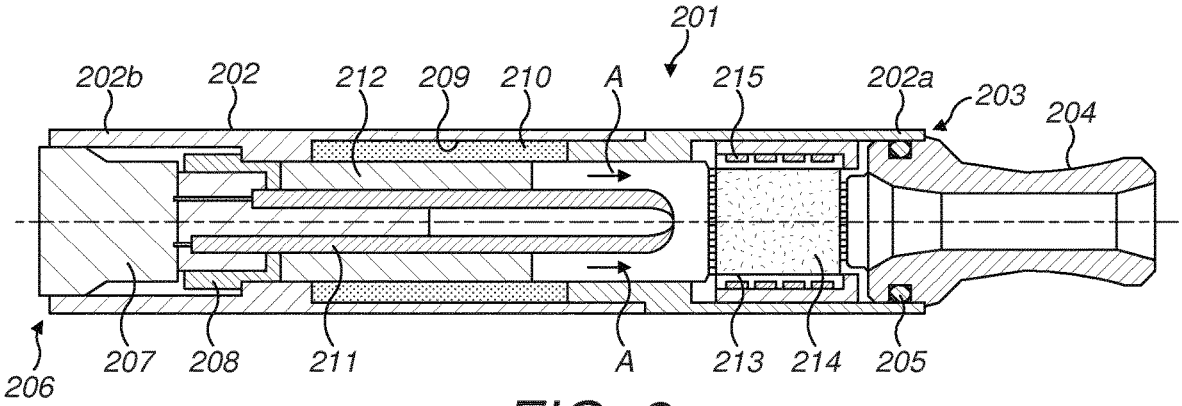
FIG. 2 shows a schematic longitudinal cross-sectional view of another example of an apparatus for generating an inhalable medium.

Referring now to FIG. 2, there is shown another example of an apparatus for generating an inhalable medium. In the following description and in FIG. 2, components and features that are the same as or similar to the corresponding components and features of the example described with reference to FIG. 1 have the same reference numeral but increased by 200. For the sake of brevity, the description of those components and features will not be repeated in its entirety here. It will be understood that the arrangements and alternatives, etc. described above in relation to the example of FIG. 1 are also applicable to the example of FIG. 2. Again, in broad outline, the apparatus 201 of FIG. 2 heats a liquid to form a vapor or an aerosol which passes through a tobacco composition 214 so as to produce an inhalable medium that contains one or more constituents derived from the tobacco composition 214.

The apparatus 201 of this example has a generally hollow cylindrical outer housing 202 with an open end 203 and a tubular mouthpiece 204. The mouthpiece 204 in this example is removable by a user from the housing 202 and an O-ring or other seal 205 assists in sealing the mouthpiece 204 in the housing 202. A battery 207 for powering various components of the apparatus 201 and a controller 208 are provided at or towards the other end 206 of the housing 202. The housing 202 of this example is in two parts, a first part 202*a* being towards the open end 203 and a second part 202*b* towards the other end 206.

The housing 202 has a container 209 for holding or containing a liquid 210. The container 209 may be of any of the types described above in relation to the example of FIG. 1. A heater 211 is provided generally centrally (lengthwise and widthwise) of the housing 202 for volatilizing the liquid 210. In this example, the heater 211 is powered by the battery 207 and is therefore electrically connected to the battery 207. The heater 211 may be an electrically resistive heater, a ceramic heater, etc. The heater 211 may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used, including non-electrical heating arrangements and other electrical heating arrangements. An annular wick 212 surrounds the heater 211 and is in (thermal) contact with the heater 211. The outermost surface of the annular wick 212 is in contact with liquid 210 contained in the liquid container 209. The liquid 210 may be heated so as to produce an aerosol of liquid droplets or sufficiently heated to produce a vapor. The aerosol or vapor so produced exits the wick 212 and passes towards the mouthpiece 204 as shown by the arrows A under the action of the user drawing on the mouthpiece 204. The heater 211 and wick 212 may be provided as a single, effectively integral item such that the heating and wicking is effectively carried out by a single unit. In some cases, the heater may be surrounded by an annular wick (as described above), and in other cases, the wick may be surrounded by an annular heater.

The housing 202 further contains a chamber 213 which holds or contains a tobacco composition 214 in the apparatus 201. The chamber 213 may be of any of the types described above in relation to the example of FIG. 1. The tobacco composition 214 is located in the housing 202 downstream of the location where the aerosol or vapor is produced from the liquid 210 and upstream of the open end 203 of the housing 202 and the mouthpiece 204. In this particular example, the tobacco composition 214 is effectively provided in the same portion or chamber of the housing 202 as the wick 212. The aerosol or vapor produced from the liquid 210 exits the wick 212 and passes as shown by the arrows A towards the tobacco composition 214 under the action of the user drawing on the mouthpiece 204. In particular embodiments, the tobacco composition 214 is porous so that the aerosol or vapor passes through the tobacco composition 214 and then through the open end 203 of the housing 202 and the mouthpiece 204. In some embodiments, the tobacco composition 214 and/or its chamber 213 are arranged so that there is no air gap between the tobacco composition 214/chamber 213 and the interior of the housing 202 so that the aerosol or vapor flows entirely through the tobacco composition 214. As the aerosol or vapor passes through and over the tobacco composition 214, the hot aerosol or vapor entrains organic and other compounds or constituents from the tobacco composition 214 that lend tobacco its organoleptic properties, thus imparting the flavor to the aerosol or vapor as is passes to the mouthpiece 204. The container 209 for containing the liquid 210 may itself be arranged to support or carry the tobacco composition 214. For example, the container 209 may have one or more clips or a tube or the like for receiving and holding the tobacco composition 214 in position. Such a dual function container 209/chamber or receptacle 213 for both containing the liquid 210 and receiving the tobacco composition 214 may be in the form of a cartridge or the like and may be a disposable item or may be re-useable, with the liquid 210 and tobacco composition 214 being replaced or topped up by the user as required. In some cases, it may be that the user only needs to top up or replace the tobacco composition 214 from time to time, with sufficient liquid 210 being provided for several uses. Once the liquid 210 has been consumed, the user disposes of the dual function container 209/receptacle 213 and uses a new one. Likewise, it may be that the user only needs to top up or replace the liquid 210 from time to time, with sufficient tobacco composition 214 being provided for several uses. Once the tobacco composition 214 has been consumed, the user disposes of the dual function container 209/receptacle 213 and uses a new one.

In the example apparatus 201 of FIG. 2, a second heater 215, such as an oven heater, is provided in thermal contact with the tobacco composition 214 to pre-heat the tobacco composition 214 and/or provide additional heat to the tobacco composition 214 throughout use of the apparatus 201. This encourages release of constituents from the tobacco composition 214 as the vapor or aerosol passes through the tobacco composition 214 in use. This also optionally allows a lower temperature to be used for the heated liquid 210, which reduces the power consumption of the first heater 211 which heats the liquid 210, and also may allow the amount of heated liquid 210 that has to be used to achieve sufficient heating of the tobacco composition 214 to be reduced. The second heater 215 may be an electrically resistive heater, a ceramic heater, etc., powered by for example the battery 207. The second heater 215 may be for example a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. Other heating arrangements may be used for the second heater 215, including non-electrical heating arrangements.

In the example apparatus 201 of FIG. 2, the heater 215 for heating the tobacco composition 214 is provided externally of the tobacco composition 214 and heats the tobacco composition 214 by heat conduction from the exterior of the tobacco composition 214. The heater 215 in this example is generally cylindrical. The heater 215 may in effect be an integral part of the apparatus 201 and be provided as part of the housing 202. As an alternative, the heater 215 may be provided integrally with the chamber 213 which holds or contains the tobacco composition 214. In this alternative, in the case that the chamber 213 is disposable, the heater 215 will be replaced when a new chamber 213 with fresh tobacco is loaded into the apparatus 201 by the user.

Figure 3:
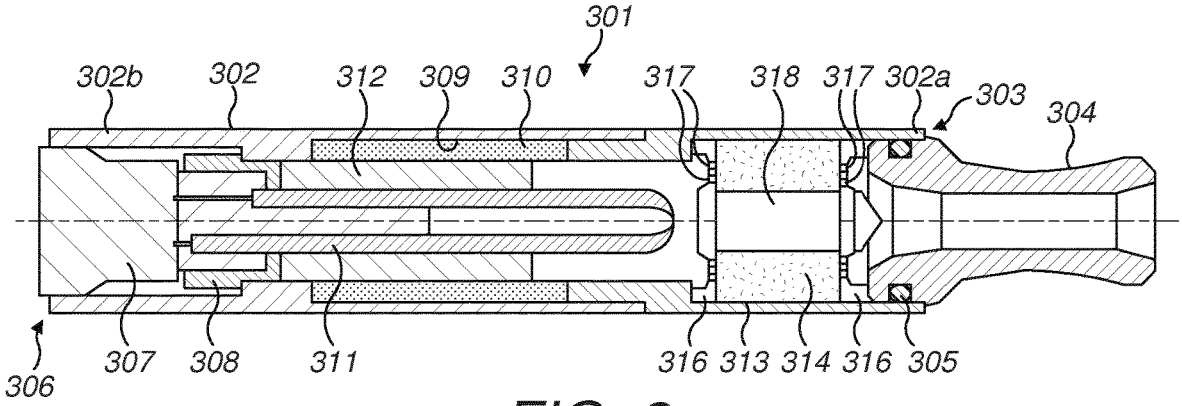
FIG. 3 shows a schematic longitudinal cross-sectional view of another example of an apparatus for generating an inhalable medium.

Referring now to FIG. 3, there is shown another example of an apparatus for generating an inhalable medium. In the following description and in FIG. 3, components and features that are the same as or similar to the corresponding components and features of the example described with reference to FIG. 1 have the same reference numeral but increased by 300. For the sake of brevity, the description of those components and features will not be repeated in its entirety here. It will be understood that the arrangements and alternatives, etc. described above in relation to the examples of FIG. 1 and FIG. 2 are also applicable to the example of FIG. 3. Again, in broad outline, the apparatus 301 of FIG. 3 heats a liquid to form a vapor or an aerosol which passes through a tobacco composition 314 so as to produce an inhalable medium that contains one or more constituents derived from the tobacco composition 314.

The apparatus 301 of this example again has a generally hollow cylindrical outer housing 302 with an open end 303 and a tubular mouthpiece 304, which is removable by a user from the housing 302. O-ring or other seal 305 assists in sealing the mouthpiece 304 in the housing 302. A battery 307 for powering various components of the apparatus 301 and a controller 308 are provided at or towards the other end 306 of the housing 302. The housing 302 of this example is again in two parts, a first part 302*a* being towards the open end 303 and a second part 302*b* towards the other end 306.

The housing 302 has a container 309 for holding or containing a liquid 310. The container 309 may be of any of the types described above in relation to the examples of FIGS. 1 and 2. A heater 311 is provided generally centrally of the housing 302 for heating the liquid 310. The heater 311 may be any of the types described above. In this example, the heater 311 is powered by the battery 307 and is therefore electrically connected to the battery 307. An annular wick 312 surrounds the heater 311 and is in (thermal) contact with the heater 311. The outermost surface of the annular wick 312 is in contact with liquid 310 contained in the liquid container 309. The liquid 310 may be heated so as to produce an aerosol of liquid droplets or sufficiently heated to produce a vapor. The aerosol or vapor so produced exits the wick 312 and passes towards the mouthpiece 304 as shown by the arrows A under the action of the user drawing on the mouthpiece 304. The heater 311 and wick 312 may be provided as a single, effectively integral item such that the heating and wicking is effectively carried out by a single unit. In some cases, the heater may be surrounded by an annular wick (as described above), and in other cases, the wick may be surrounded by an annular heater.

The housing 302 further contains a chamber 313 which holds or contains a tobacco composition 314 in the apparatus 301. The chamber 313 may be of any of the types described above in relation to the examples of FIGS. 1 and 2. (In the example shown in FIG. 3, the chamber 313 is in the form of a tube which has end walls 316 which have through holes 317 through which a vapor or aerosol can pass, which was mentioned as an option above.) The tobacco composition 314 is located in the housing 302 downstream of the location where the aerosol or vapor is produced from the liquid 310 and upstream of the open end 303 of the housing 302 and the mouthpiece 304. In this particular example, again, the tobacco composition 314 is effectively provided in the same portion or chamber of the housing 302 as the wick 312. The aerosol or vapor produced from the liquid 310 exits the wick 312 and passes as shown by the arrows A towards the tobacco composition 314 under the action of the user drawing on the mouthpiece 304. In particular embodiments, the tobacco composition 314 is porous so that the aerosol or vapor passes through the tobacco composition 314 and then through the open end 303 of the housing 302 and the mouthpiece 304. In some embodiments, the tobacco composition 314 and/or its chamber 313 are arranged so that there is no air gap between the tobacco composition 314/chamber 313 and the interior of the housing 302 so that the aerosol or vapor flows entirely through the tobacco composition 314. As the aerosol or vapor passes through and over the tobacco composition 314, the hot aerosol or vapor entrains organic and other compounds or constituents from the tobacco composition 314, thus imparting tobacco flavor to the aerosol or vapor as is passes to the mouthpiece 304. The container 309 for containing the liquid 310 may itself be arranged to support or carry the tobacco composition 314. For example, the container 309 may have one or more clips or a tube or the like for receiving and holding the tobacco composition 314 in position. Such a dual function container 309/chamber or receptacle 313 for both containing the liquid 310 and receiving the tobacco composition 314 may be in the form of a cartridge or the like and may be a disposable item or may be re-useable, with the liquid 310 and tobacco composition 314 being replaced or topped up by the user as required. In some cases, it may be that the user only needs to top up or replace the tobacco composition 314 from time to time, with sufficient liquid 310 being provided for several uses. Once the liquid 310 has been consumed, the user disposes of the dual function container 309/receptacle 313 and uses a new one. Likewise, it may be that the user only needs to top up or replace the liquid 310 from time to time, with sufficient tobacco composition 314 being provided for several uses. Once the tobacco composition 314 has been consumed, the user disposes of the dual function container 309/receptacle 313 and uses a new one.

In the example apparatus 301 of FIG. 3, a second heater 318 is again provided in thermal contact with the tobacco composition 314 to heat the tobacco composition 314 to encourage release of constituents from the tobacco composition 314 as the vapor or aerosol passes through the tobacco composition 314 in use. The second heater 318 may be an electrically resistive heater, a ceramic heater, etc., powered by for example the battery 307. Other heating arrangements may be used for the second heater 318, including non-electrical heating arrangements.

In the example apparatus 301 of FIG. 3, the heater 318 for heating the tobacco composition 314 is provided internally of the tobacco composition 314 and heats the tobacco composition 314 by heat conduction from the interior of the tobacco composition 314. The heater 318 in this example is generally in the form of a cylindrical rod located along the central longitudinal axis of the tobacco composition 314. In other arrangements, the heater 318 may be a wire, which may for example be in the form of a coil, a plate (which may be a multi-layer plate of two or more different materials, one or more of which may be electrically conductive and one or more of which may be electrically non-conductive), a mesh (which may be woven or non-woven for example, and which again may be similarly multi-layer), a film heater, etc. The tobacco composition 314 in this case is generally tubular or otherwise has an internal aperture for receiving the heater 318. The heater 318 may in effect be an integral part of the apparatus 301 and be provided as part of the housing 302. In this case, as the tobacco composition 314 is loaded into the apparatus 301 (for example, as the chamber 313 containing the tobacco composition 314 is loaded into the apparatus 301), the tobacco composition 314 surrounds the second heater 318. As an alternative, the heater 318 may be provided integrally with the chamber 313 which holds or contains the tobacco composition 314. In this alternative, in the case that the chamber 313 is disposable, the heater 318 will be replaced when a new chamber 313 with fresh tobacco is loaded into the apparatus 301 by the user.

In another example, plural internal heaters 318 may be provided, so as to provide for more efficient heating of the tobacco composition 314. In another example, the tobacco composition 314 may be heated by both one or more external heaters (like the second heater 215 of the example of FIG. 2) and by one or more internal heaters (like the second heater 318 of the example of FIG. 3).

Figure 4:
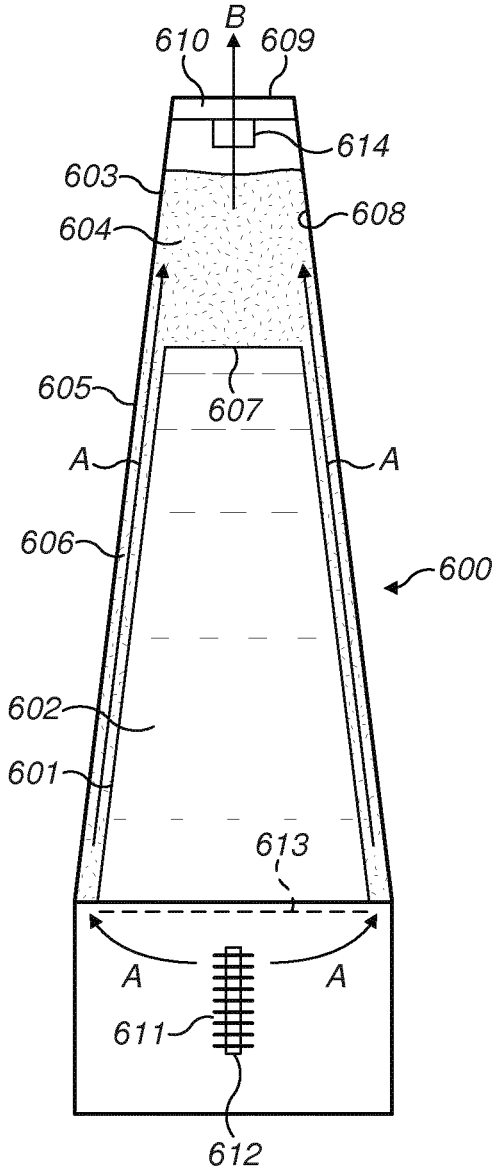

Referring now to FIG. 4, there is shown a schematic longitudinal cross-sectional view of an example of a cartridge 600 having a liquid container 601 for containing liquid 602 and a receptacle or container 603 for tobacco composition 604. In this example, the liquid container 601 and the tobacco composition container 603 are provided as one integral component, either by being formed integrally initially or being formed initially of two parts which are then assembled in a substantially permanent fashion. The cartridge 600 is arranged so that as the liquid 602 is volatilized so as to produce an aerosol of liquid droplets or sufficiently heated to produce a vapor, at least some and preferably all or substantially all of the aerosol or vapor passes through the tobacco composition 604 to pick up flavor from the tobacco composition 604.

In the example of FIG. 4, the liquid container 601 is provided generally centrally of the cartridge 600. The liquid container 601 in the example shown is frustoconical in shape, but may have a different shape, such as conical, cylindrical, etc. The liquid container 601 is surrounded by an outer shell 605 which defines an annular channel 606 around the outside of the length of the liquid container 601 and which extends from one end of the liquid container 601 to the other. The outer shell 605 extends beyond a first end wall 607 of the liquid container 601 to define a chamber 608 beyond the first end wall 607 of the liquid container 601. In the example shown, both the chamber 608 and the annular channel 606 contain the tobacco composition 604 and so can be regarded as together providing the container 603 for the tobacco composition 604. In other examples, the tobacco composition 604 may be provided only in the chamber 608, which therefore defines the container 603 for the tobacco composition 604, and the annular channel 606 is empty. The chamber 608 is closed off by an end wall 609 which is spaced from the end wall 607 of the liquid container 601. The end wall 609 may be part of the outer shell 605 or may be a separate plastics or rubber cap or the like. In yet other examples, the annular channel 606 contains the tobacco composition 604 and there is no material in the chamber 608, and indeed the chamber 608 may be omitted and the channel 606 effectively terminates at the end wall 609. The channel 606 and/or chamber 608 may be entirely filled with tobacco composition 604 or may only contain a portion or plug of tobacco composition 604. The end wall 609 is porous and/or has one or more through holes 610 to enable the aerosol or vapor to exit the cartridge 600 to be inhaled by a user. The liquid container 601 and the solid container 603 may each be formed of rigid, watertight and airtight materials, such as metal, suitable plastics, etc.

The example cartridge 600 shown in FIG. 4 is provided with a heater 611 and a wick 612 in (thermal) contact with the heater 611. In this example, the heater 611 and the wick 612 are provided as a single unit, often referred to as an "atomizer." In this case, where the cartridge 600 includes an atomizer, such a cartridge is often referred to as a "cartomizer." The orientation of the heater 611 is shown schematically and for example the heater 611 may be a coil having its longitudinal axis perpendicular to the longitudinal axis of the cartridge 600 rather than parallel as shown in FIG. 4.

The wick 612 is in contact with the liquid 602. This may be achieved by for example the wick 612 being inserted through a through hole (not shown) in the second end wall 613 of the liquid container 601. Alternatively or additionally, the second end wall 613 may be a porous member (shown schematically in FIG. 4 by dashed lines) which allows liquid to pass through from the liquid container 601, and the wick 612 may be in contact with the porous second end wall 613. The second end wall 613 may be for example in the form of a porous ceramic disk. A porous second end wall 613 of this type helps to regulate the flow of liquid onto the wick 612. The wick 612 is generally absorbent and acts to draw in liquid 602 from the liquid container 601 by capillary action. The wick 612 is preferably non-woven and may be for example a cotton or wool material or the like, or a synthetic material, including for example polyester, nylon, viscose, polypropylene or the like.

In use, the cartridge 600 is connected by the user to a battery section of an apparatus (not shown) to enable the heater 611 to be powered. When the heater 611 of the atomizer is powered (which may be instigated for example by the user operating a button of the overall apparatus or by a puff detector of the overall apparatus, as is known per se), liquid 602 drawn in from the liquid container 601 by the wick 612 is heated by the heater 611 to volatilize or vaporize the liquid. As the user draws on a mouthpiece of the overall apparatus, the vapor or aerosol passes into the annular channel 606 around the outside of the length of the liquid container 601 and into the chamber 608 as shown by the arrows A. The vapor or aerosol picks up flavor from the tobacco composition 604. The vapor or aerosol may contain nicotine entrained from the tobacco composition 604. The vapor or aerosol can then exit the cartridge 600 through the end wall 609 as shown by the arrow B. A one way valve 614 may be provided inside the end wall 609 so that the vapor or aerosol can only exit the cartridge 600 and cannot back-flow to the heater 611 or the electronics of the apparatus as a whole.

Figure 5:
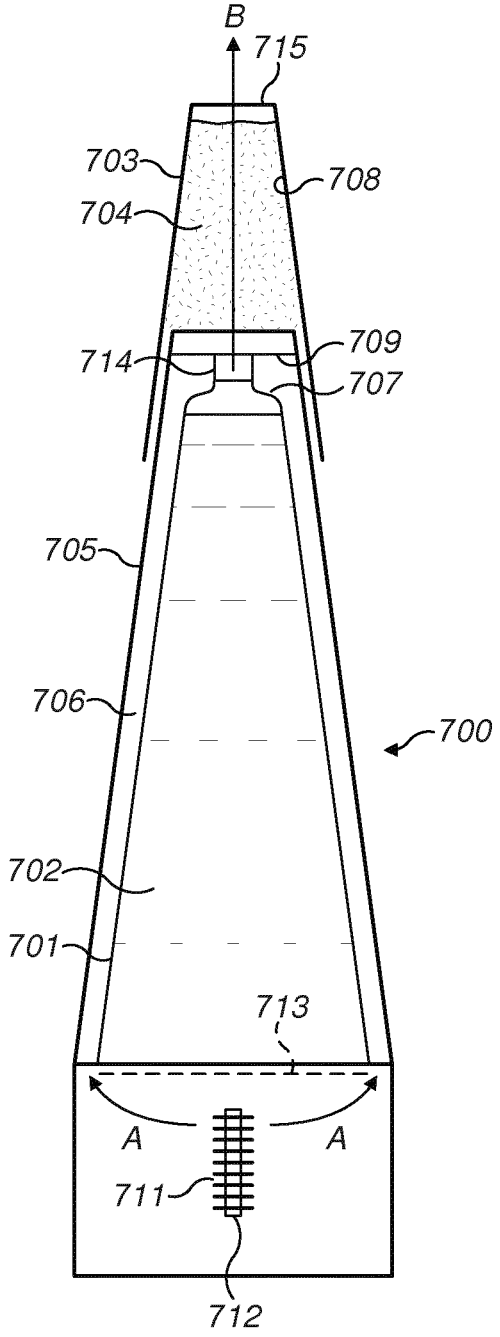
FIG. 5 shows a schematic longitudinal cross-sectional view of an example of a cartridge having a liquid container and a detachable container for solid material.

Referring now to FIG. 5, there is shown a schematic longitudinal cross-sectional view of another example of a cartridge 700 having a liquid container 701 for containing liquid 702 and a container 703 which defines a chamber 708 for containing tobacco composition 704. In the following description and in FIG. 5, components and features that are the same as or similar to the corresponding components and features of the example described with reference to FIG. 4 have the same reference numeral but increased by 100. For the sake of brevity, the description of those components and features will not be repeated in its entirety here.

In this example, the liquid container 701 and the tobacco composition container 703 of the cartridge 700 are provided as separate components, which are detachably connected to each other in use. The liquid container 701 and the tobacco composition container 703 may for example be clipped or otherwise detachably fixed to each other, or for example the tobacco composition container 703 may simply rest on or be a tight friction fit on the liquid container 701. The cartridge 700 is arranged so that as the liquid 702 is volatilized so as to produce an aerosol of liquid droplets or sufficiently heated to produce a vapor, at least some and preferably all or substantially all of the aerosol or vapor passes through the tobacco composition 704 to pick up flavor from the tobacco composition 704.

In this example, the liquid container 701 is surrounded by an outer shell 705 which defines an annular channel 706 around the outside of the length of the liquid container 701 and which extends from one end of the liquid container 701 to the other. The outer shell 705 extends beyond a first end wall 707 of the liquid container 601 and terminates in an end wall 709. The end wall 709 may be a separate plastics or rubber cap or the like. The end wall 709 is porous and/or has one or more through holes 710 to enable the aerosol or vapor to exit the annular channel 706. A one way valve 714 may be provided inside the end wall 709 so that the vapor or aerosol can only exit the annular channel 706 at the end remote from the heater 711 and wick 712 and cannot back-flow to the heater 711 or the electronics of the apparatus as a whole. The tobacco composition container 703 is located in use over the end wall 709 so that vapor or aerosol exiting through the end wall 709 passed into the tobacco composition container 703. The tobacco composition container 703 has an exit aperture and/or or a porous end wall 715 to enable the aerosol or vapor to exit the cartridge 700 to be inhaled by a user.

In use, the cartridge 700 is connected by the user to a battery section of an apparatus (not shown) to enable the heater 711 to be powered. When the heater 711 of the atomizer is powered (which may be instigated for example by the user operating a button of the overall apparatus or by a puff detector of the overall apparatus as is known per se), liquid 702 drawn in from the liquid container 701 through the end wall 713 by the wick 712 is heated by the heater 711 to volatilize or vaporize the liquid. As the user draws on a mouthpiece of the overall apparatus, the vapor or aerosol passes into the annular channel 706 around the outside of the length of the liquid container 701 towards the end wall 709 of the outer shell 705 as shown by the arrows A. The vapor or aerosol then passes through the end wall 709 (via the one-way valve 714 if present) and into the tobacco composition container 703 where it picks up flavor from the tobacco composition 704 contained in the container 703. The vapor or aerosol may contain nicotine entrained from the tobacco composition 704. The vapor or aerosol can then exit the cartridge 700 through the end wall 715 of the tobacco composition container 703 as shown by the arrow B.

The examples shown in FIGS. 4 and 5 are particularly suitable for use with so-called modular or "e-go" products, in which the cartomizer is fitted to a battery section (not shown), typically by a screw thread, a bayonet fitting or the like. The cartomizer as a whole is typically discarded after use and a new, replacement cartomizer used. As an alternative, it may be possible for the user to re-use the cartridge by refilling the liquid and/or replacing the solid material from time to time as necessary.

The examples shown in FIGS. 4 and 5 may easily be adapted for use with other types of an electronic tobacco hybrid device, which are known per se. There are for example so-called "look alike e-cigarette" or "cig-alike" devices which are generally small and have a form and appearance similar to a conventional cigarette. In such devices, the liquid container typically includes some wadding material, of for example cotton or the like, for holding the liquid. The cartridge or cartomizer in such known devices is typically disposable as a whole, but it may be possible to refill the liquid and/or replace the sold material in examples that use an embodiment. As another example, there are so-called tank devices or personal vaporizers which generally have large liquid containers for holding relatively large volumes of liquid and also provide for advanced functions that allow users to control a number of aspects of the device.

As an alternative to any of the cartomizer arrangements discussed above, the atomizer (i.e. the heater and the wick) for the liquid may be provided separately of the liquid and material containers. The atomizer may for example be provided as part of the battery section of the overall apparatus to which the cartridge is detachably fitted by the user in use.

In any of the examples described above in relation to FIGS. 4 and 5, there may also be provided a heater for the tobacco composition so as to "pre-heat" it. This heater may be provided as part of the cartridge or as part of the battery section of the apparatus to which the cartridge is fitted in use.

Other devices in which the tobacco composition described herein may be used are described in US201400299125A1, U.S. Pat. No. 7,726,320B2, WO2014116974A1, US2013014772A1 and CN104397876A, all of which are incorporated herein by reference in their entirety.

Examples

The following porous tobacco compositions were formed by mixing together the tobacco constituents.

Each composition was prepared in shredded (cut rag) form and placed in an electronic tobacco hybrid device. The device comprised a liquid comprising nicotine. On heating to about 250° C., the liquid was vaporized and drawn through the device by the user inhaling. Before reaching a device output, the vapor passed through the porous tobacco composition, entraining components of the composition in the aerosol.

The aerosols were subjected to taste testing and were found to have good organoleptic properties.

In the compositions described herein, where amounts are given in % by weight, for the avoidance of doubt this refers to a dry weight basis, unless specifically indicated to the contrary. Weight ratios are also quoted on a dry weight basis, unless specifically indicated to the contrary. Thus, any water that may be present in the tobacco composition, or in any component thereof, is entirely disregarded for the purposes of the determination of the weight %. The water content of the tobacco compositions described herein may vary and may be, for example, from 5 to 15% by weight. The water content of the tobacco compositions described herein may vary according to, for example, the temperature, pressure and humidity conditions at which the compositions are maintained. The water content can be determined by Karl-Fisher analysis, or by gas chromatography.

On the other hand, for the avoidance of doubt, when liquid components other than water are present, such as glycerol or propylene glycol, these components are included in the weight of the tobacco composition. Further, where other ingredients are present in a tobacco component such as flavorings or casings, these are included in the weight of the tobacco component, even if of non-tobacco origin.

For the avoidance of doubt, where in this specification the term "comprises" is used in defining embodiments or features of the invention, embodiments are also disclosed in which the embodiment or feature can be defined using the terms "consists essentially of" or "consists of" in place of "comprises."

The above embodiments are to be understood as illustrative examples of the invention. Further embodiments of the invention are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

| Tobacco type | Composition 1 (wt %) | Composition 2 (wt %) | Composition 3 (wt %) | Composition 4 (wt %) | Composition 5 (wt %) |
|---|---|---|---|---|---|
| Full-flavored flue-cured Virginia tobacco** | 10 | 20 | 0 | 0 | 5 |
| Treated flue-cured tobacco* | 10 | 30 | 50 | 30 | 5 |
| Dark air-cured tobacco | 50 | 0 | 50 | 50 | 65 |
| Sun-cured tobacco** | 30 | 0 | 0 | 0 | 10 |
| Dark fire-cured tobacco | 0 | 50 | 0 | 20 | 15 |

*The treated tobacco was prepared by placing flue-cured tobacco (13 wt % moisture) in a C48 cardboard box, wrapping this in polyethylene and heating it to 60° C. at 60% relative humidity for 30 days.
**These tobaccos have not been subjected to any treatment beyond curing which affects the flavor properties of tobacco.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention, and that other embodiments may be used and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A composition for use in a device for generating an inhalable medium, the composition comprising:

50-85% by weight of a first tobacco component that has been dark air-cured, dark fire-cured, or both dark air-cured and dark fire-cured;

5-50% by weight of a second tobacco component that has been flue-cured, sun-cured, or both flue-cured and sun-cured, said second tobacco component having not been subjected to any flavor treatment beyond flue-curing and/or sun-curing, and 5-50% by weight of a third tobacco component that has been flue-cured, sun-cured, or both flue-cured and sun-cured, wherein only the third tobacco component has been subjected to a flavor enhancing Maillard reaction, the Maillard reaction enhancing the flavor properties of the third tobacco component, and wherein the first, second and third tobacco components are mixed together to form a porous tobacco composition with the Maillard reaction occurring prior to mixing the third tobacco component with the first and second tobacco components.

2. The composition of claim 1, wherein the further treatment comprises producing the third tobacco product by the process of providing a tobacco material within a moisture-retaining material and exposing the tobacco material to a processing temperature at least about 45° C. wherein the tobacco material has a packing density on a dry weight basis of at least 200 kg/m$^3$ at the start of the process and has a moisture content of between about 10% and 23% before and during the treatment.

3. The composition of claim 1 wherein the composition comprises:

50-65% by weight of the first tobacco component, 35-50% by weight of the second tobacco component, and 5-15% by weight of the third tobacco component.

4. The composition of claim 1 wherein the composition comprises:

50-65% by weight of the first tobacco component, 10-30% by weight of the second tobacco component, and 20-40% by weight of the third tobacco component.

5. The composition of claim 1 wherein the composition comprises:

50-65% by weight of the first tobacco component, 5-10% by weight of the second tobacco component, and 35-50% by weight of the third tobacco component.

6. The composition of claim 1 wherein the composition comprises:

65-75% by weight of the first tobacco component, 5-10% by weight of the second tobacco component, and 25-35% by weight of the third tobacco component.

7. The composition of claim 1 wherein the composition comprises:

70-85% by weight of the first tobacco component, 5-25% by weight of the second tobacco component, and 5-10% by weight of the third tobacco component.

* * * * *